United States Patent [19]

Kajiyama

[11] Patent Number: 4,493,399

[45] Date of Patent: Jan. 15, 1985

[54] ELEVATOR CONTROL SYSTEM

[75] Inventor: Ryuichi Kajiyama, Inazawa, Japan

[73] Assignee: Mitsubishi Denki Kabushiki Kaisha, Tokyo, Japan

[21] Appl. No.: 492,007

[22] Filed: May 5, 1983

[30] Foreign Application Priority Data

May 11, 1982 [JP] Japan ..... 57-78605

[51] Int. Cl.[3] ..... B66B 1/18

[52] U.S. Cl. ..... 187/29 R

[58] Field of Search ..... 187/29 R, 29

[56] References Cited

U.S. PATENT DOCUMENTS

| | | | |
|---|---|---|---|
| 4,246,983 | 1/1981 | Bril | 187/29 R |
| 4,266,632 | 5/1981 | Yoneda et al. | 187/29 R |
| 4,326,606 | 4/1982 | Kuzunuki et al. | 187/29 R |
| 4,341,287 | 7/1982 | Kuzunuki et al. | 187/29 R |
| 4,367,811 | 1/1983 | Yoneda et al. | 187/29 R |
| 4,410,959 | 10/1983 | Tajima et al. | 187/29 R X |

FOREIGN PATENT DOCUMENTS 56-48376 5/1981 Japan .

*Primary Examiner*—J. V. Truhe
*Assistant Examiner*—Paul Shik Luen Ip
*Attorney, Agent, or Firm*—Leydig, Voit, Osann, Mayer and Holt, Ltd.

[57] ABSTRACT

Described is a control system for an elevator wherein the distance between the current car position and the target position of a floor at which the car is to be halted is detected on the basis of a car position signal computed from car displacements and a preliminarily stored floor position signal for controlling the car speed. According to the present invention, the contents of a read-only floor memory concerning the respective floor positions stated in the building plan or schedule are transferred at the outset into a transient read/write floor memory. In the course of the subsequent elevator car travel, the data in said transient floor memory is corrected through the learning of the contents of the car position signal computed during car displacements. In this manner, the car may be controlled to arrive at a target floor accurately despite occasional difference between the actual floor position and the design floor positions.

4 Claims, 14 Drawing Figures

ELEVATOR CONTROL SYSTEM

BACKGROUND OF THE INVENTION

This invention relates to an elevator control system.

In general, for improving the riding comfort of passengers in the elevator car and possibly eliminating errors in stopping the car at a desired target floor level, it is necessary not only to provide for adequate speed control but also to accurately detect the current car position. It may be contemplated that the driving motor speed control may be made based on a deceleration command signal corresponding to the remaining distance between the current car position and the target floor level thereby reducing level gap errors between the car level and the floor level.

So far, in detecting the current car position and computing the remaining distance to the target floor level, it is known in the art to use a floor memory consisting of a read-only memory for storing numbers corresponding to the floor positions in a binary format, and a current position counter, which is designed to compute the current car position based on the pulsed output of a tachometer generator coupled to a car being driven by an electric motor and to produce an output corresponding to the current car position similarly in the binary format. The floor positions as specified in the building are stored in the floor memory.

However, due to building errors or contraction of the building materials with the lapse of time, a certain gap, however small, is likely to occur between the actual and specified floor levels or positions. The result is that a gap or difference occurs between the car floor and the hall floor levels. In addition, any mounting error is translated directly into a corresponding constant level gap. This level gap may be reduced by providing suitable control points in the shaft for controlling the car position at these points. However, in this case, investment costs may be elevated due to provision of special devices. In addition, riding comfort may be affected by such frequent adjustment of the car positions.

Although the control system designed to obviate this inconvenience has already been proposed by the present applicant, it is not possible with this prior-art system to realize high control precision because the car is likely to surpass the target floor level during an initial period where the actual floor-to-floor distance is less than that specified in the building schedule. In addition, this prior-art system tends to be rather costly.

OBJECT OF THE INVENTION

It is therefore an object of the present invention to provide an elevator control system which enables the the car to arrive correctly at a floor level despite occasional differences between the actual and the design floor levels, and which can be implemented at a lower cost.

According to the present invention, the design floor levels are stored preliminarily in a read-only floor data memory and transferred at a specified time into a transient read/write floor data memory. The current car position is computed from car displacement for renewing the contents of the read/write memory in the course of a learning travel. Initial running of the car is initiated with the power application to the control system. During this learning travel, the car is operated in the usual manner except that the design data concerning the respective floor levels are replaced by the actual floor level data. Once the actual floor level data are entered into the transient read/write memory for the respective floors, car operation is controlled solely on the basis of the thus learned actual floor data. In addition, since the target level is set to be slightly ahead of the floor data stored in the read/write memory, there is no risk that the car should surpass the target floor level.

DESCRIPTION OF THE PREFERRED EMBODIMENT

Figure 1A:
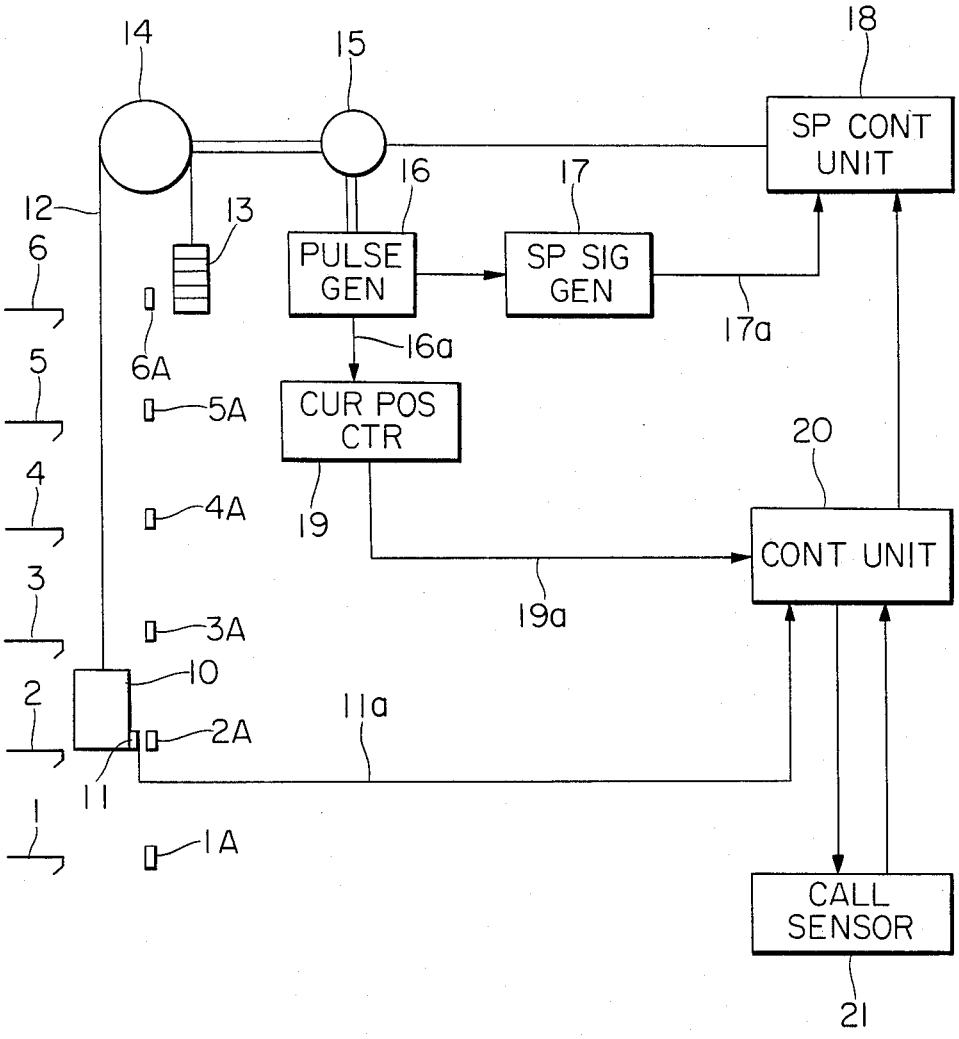
FIG. 1A is a block diagram showing an embodiment of the control system of the present invention.
Figure 1B:
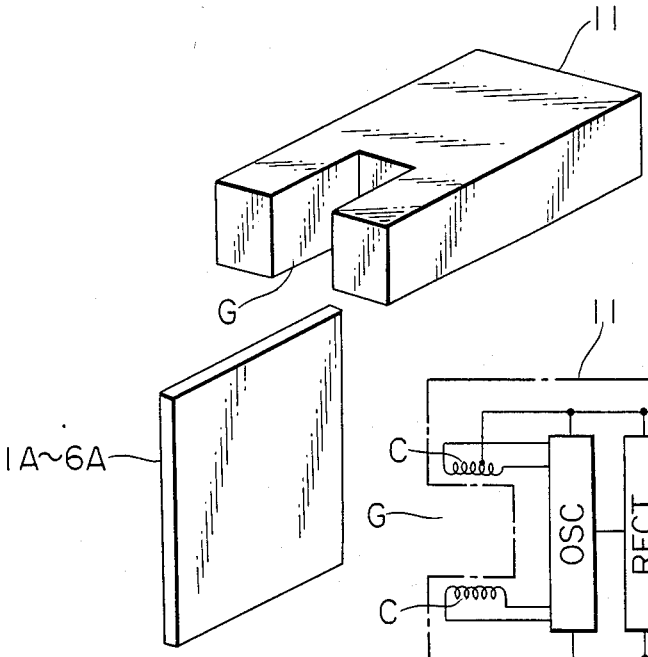
FIG. 1B is a view showing a guide plate and a floor sensor utilized in the control system.
Figure 1C:
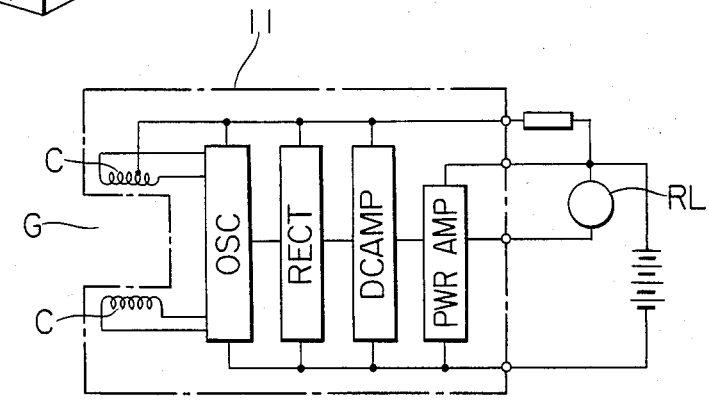
FIG. 1C shows a block diagram of the control system of the present invention.

Referring to FIG. 1, numerals 1 through 6 designate first to sixth hall floors and numerals 1A through 6A designate guide plates, e.g. aluminium plates, mounted in an elevator shaft and associated respectively with the first to sixth hall floors 1 through 6. Numeral 10 designates an elevator car and numeral 11 a floor sensor mounted in the car 10 and adapted to produce an output signal **11*a* whenever it is adjacent to the guide plates 1A through 6A. As shown in FIG. 1B, the sensor 11 has a terminal gap G into which the guide plates 1A through 6A associated with the respective floors are introduced. As shown in FIG. 1C, the sensor 11 is designed as an L-C oscillating circuit having two opposed coils C, C. The circuit is normally excited into oscillation under the effect of mutual induction between the coils. Oscillation of the circuit ceases when one of the guide plates 1A through 6A is introduced between the coils C, C. The output from the coils C, C is subjected to rectification and is amplified for driving an output relay RL. At this time, an output signal is issued from the contact of the relay RL and supplied to a control circuit 20** as will be later described for signalling the arrival of the car.

Referring to FIG. 1A, numeral 12 designates a main cable, numeral 13 a counterweight, and numeral 14 a pulley around which the main cable 12 is placed. Numeral 15 designates a hoist-up electric motor for driving the pulley 14. Numeral 16 designates a pulse generator for generating pulse signals **16*a* corresponding to the speed of the hoist-up electric motor 15. Numeral 17 designates a speed signal generator for producing a speed signal 17*a* according to an output of the pulse generator 16. Numeral 18 designates a speed control unit. Numeral 19 designates a current car position counter adapted to compute from the input pulse signal 16*a* the distance traversed by and hence the current position of the car 10 and to issue a binary car position signal 19*a*. Numeral 20 designates a control unit of the present invention and numeral 21** a call sensor circuit.

Figure 2:
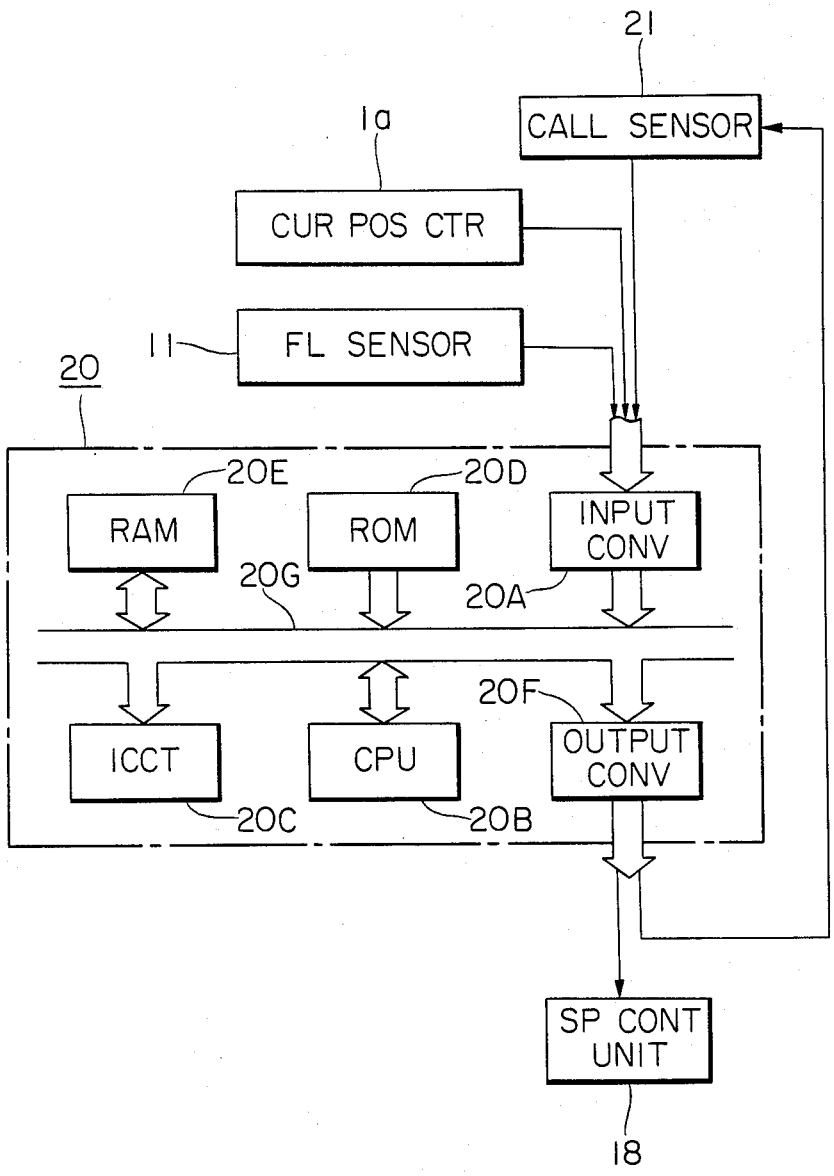
FIG. 2 is a block view showing the overall control system of the present invention.

In FIG. 2, showing the details of the control unit, numeral 20A designates an input converter for converting the input signals into computer data. Numeral 20B designates a central processing unit (CPU) and numeral 20C an interrupt cycle control timer (ICCT). The numeral 20D designates a read only memory (ROM) in which data such as a computer program described later, deceleration command values, floor data etc, are permanently entered. Numeral 20E designates a read/write memory (RAM) having memory addresses for data storage. Numeral 20F designates an output converter for converting computer data into signals for activating elevator components. The numeral 20G designates a bus such as an address or data bus.

Figure 3A:
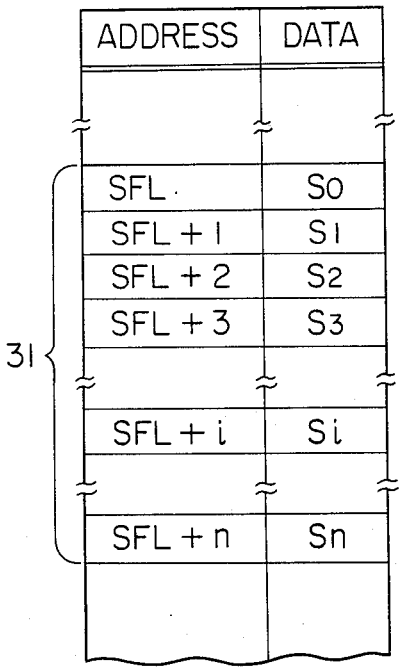
FIG. 3A and 3B are an explanatory view of the ROM program of the present invention.
Figure 3B:
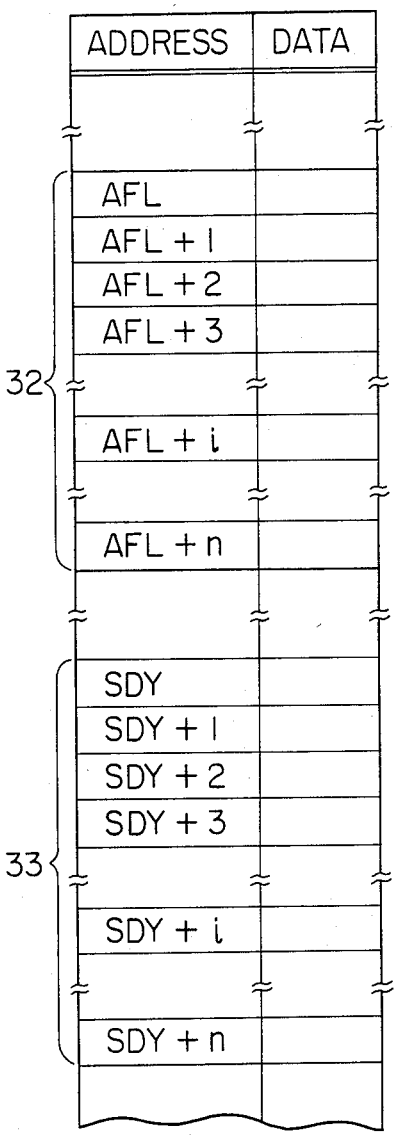

FIGS. 3A and 3B show the contents of the ROM 20D and the RAM 20E, respectively. In the drawing, the numeral 31 designates binary floor data indicating absolute positions of the respective floors according to the building schedule data. The numeral 32 designates the floor data areas of the respective floors learned by a program as later described. The numeral 33 designates a flag indicating whether the respective floor data 31 have undergone the learning process or not.

FIGS. 4 through 9 are flow charts showing the program procedure according to an embodiment of the invention.

Figure 4:
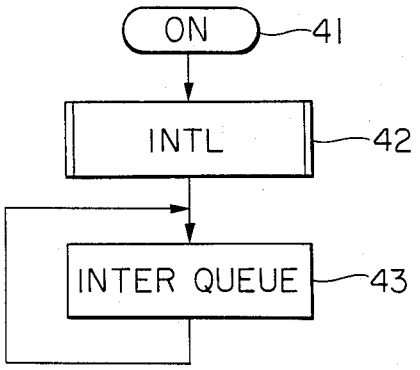
FIGS. 4 through 10 are flow charts showing the operation of the present control system.

Referring to FIG. 4, when the power has been applied as in step 41 to the computer, control proceeds to the step 42 for initializing and to the step 43 for interruption queuing.

Figure 5:
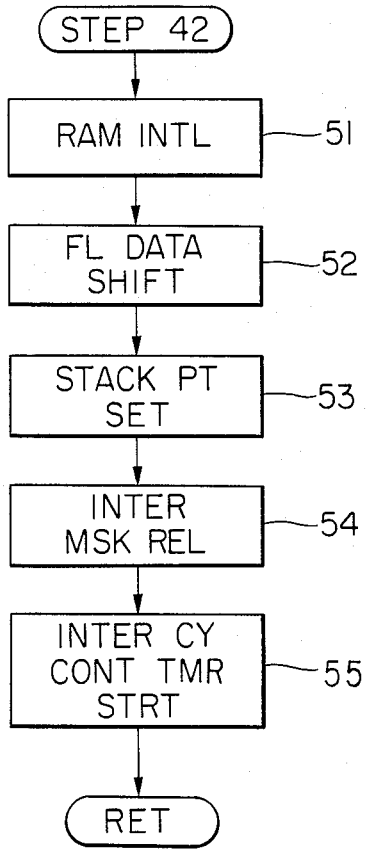

Referring to FIG. 5, after the initializing step 42, control proceeds to the step 51 for initializing the RAM 20E, and then to the step 52 for transferring floor data from the ROM 20D to floor data areas 32 of the RAM 20E shown in FIG. 3 and setting the flag 33 to the pre-learning state. Then, control proceeds to the step 53 for setting stack pointers, step 54 for releasing the interrupt mask and to the step 55 for starting an interrupt cycle control timer 20C.

Figure 6:
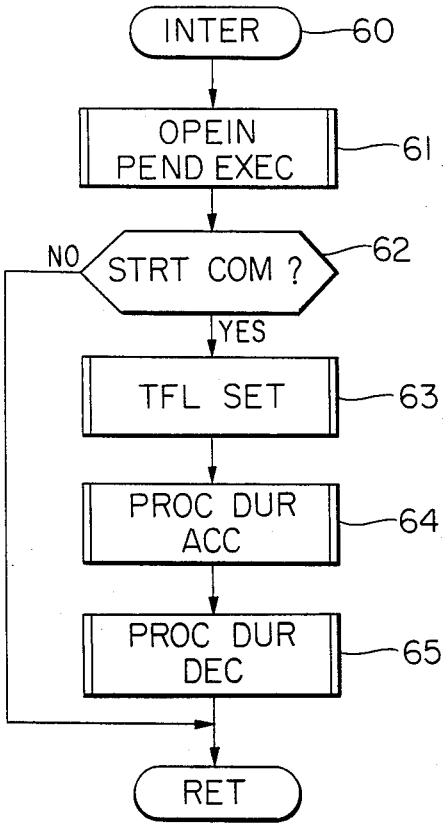

The step 60 in FIG. 6 shows that the following program is executed in case of an interruption from the timer 20C. Thus, in the step 61, the operation in pending states is executed. In the next step 62, it is checked whether there exists a start command. If there exists no start command, the steps 62 through 65 are skipped to complete the arithmetic operation. If there exists a start command, the stop target floor is set in the step 63. Then, control goes to the step 64 for executing the procedure to be taken during acceleration, and to the step 65 for executing the procedure to be taken during deceleration, as later described.

Figure 7:
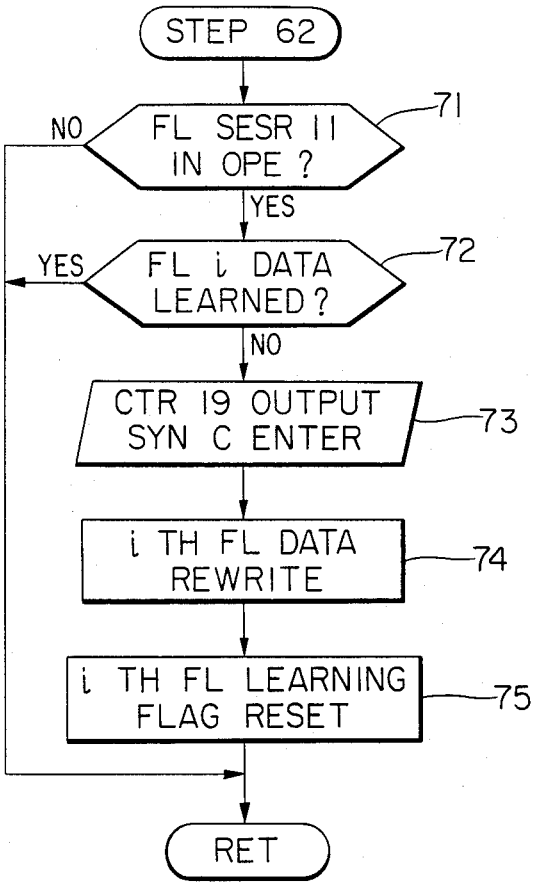
Figure 8A:
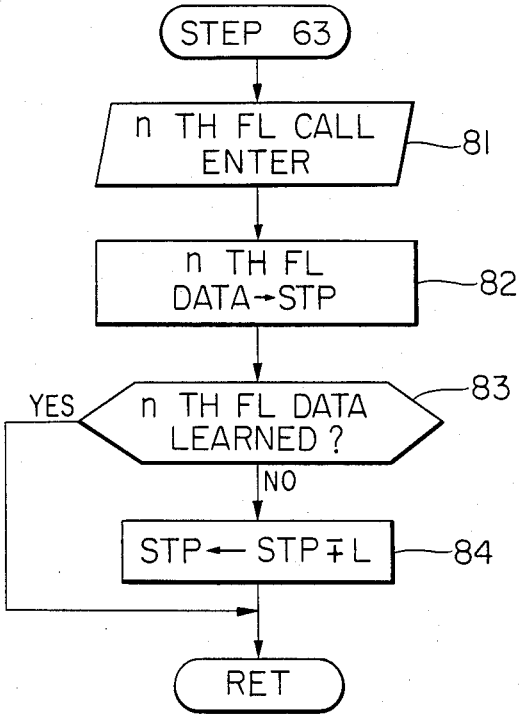
Figure 8B:
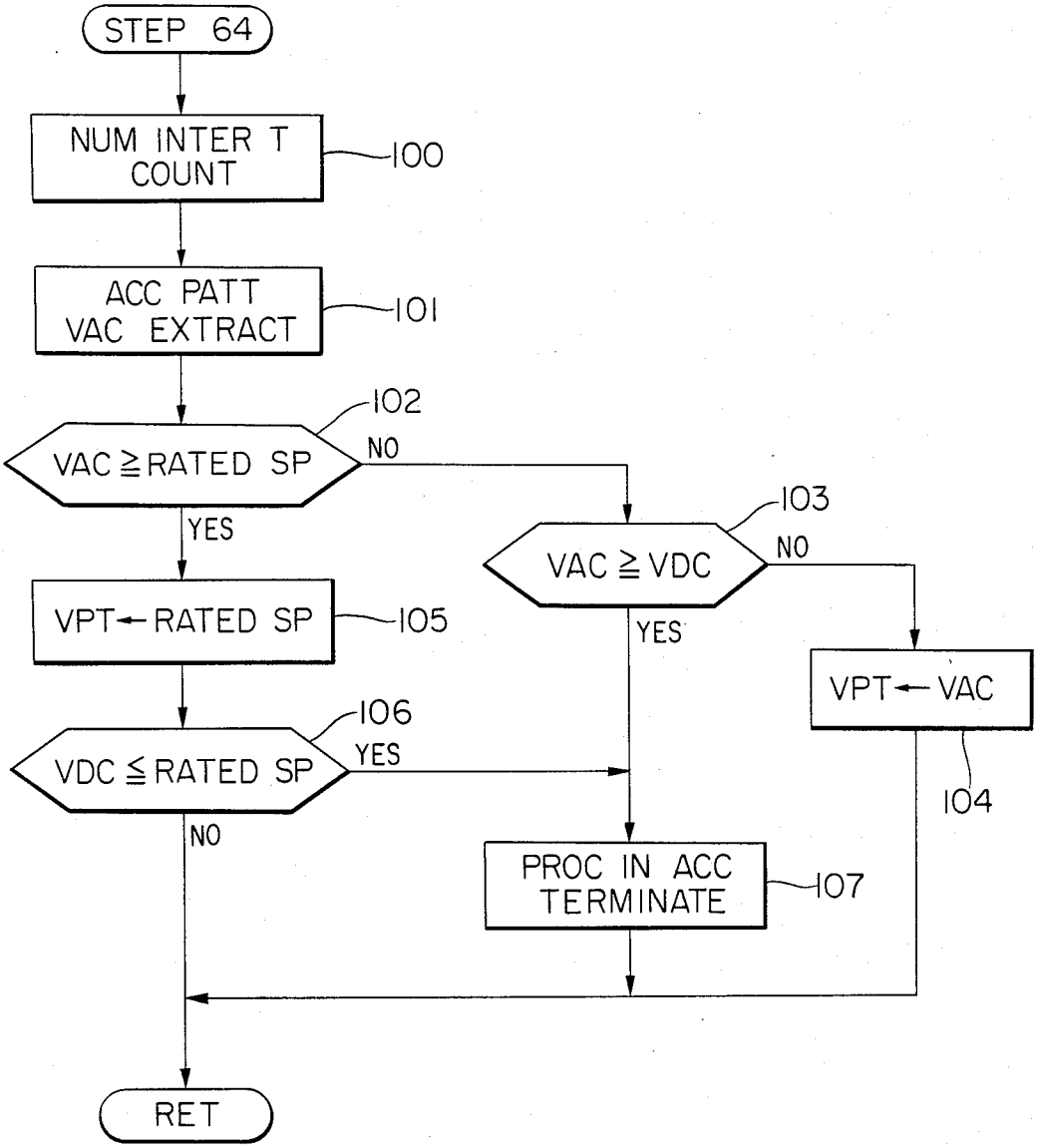
Figure 9:
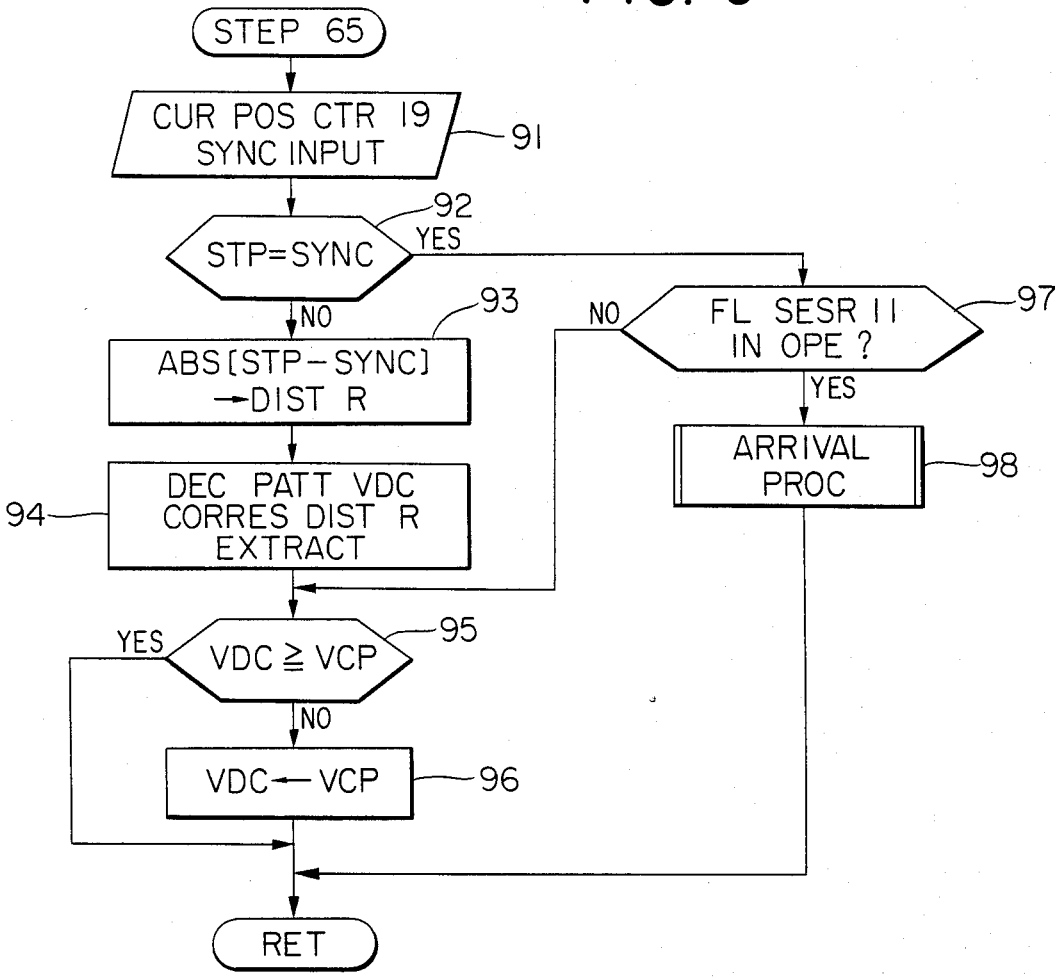

The operation of the car 10 is now described by referring to FIGS. 7 to 9.

When the car 10 is at a standstill at the second floor 2, as shown in FG. 1A, control goes from the step 62 to the next step 72 through the step 71 as shown in FIG. 7. In this step 72, the flag 33 for the second floor 2 is read out from an address (SDY+1) of RAM 20E. When the flag is found to be in the pre-learning state, the contents of the current position counter 19 (SYNC) are entered in the next step 73 and written into a floor data area 32 of RAM 20E specified by an address (AFL+1). In the next step 75, the flag (SDY+1) for the second floor is reset to indicate termination of the second floor data learning to complete the operation of the step 62.

Next, when a call has been made at the third floor, and a start command is issued, as shown in FIG. 8A, n=3 which stands for the calling floor is entered in the step 81 by the call sensor circuit 21. In the next step 82, the floor data $S_2$ for the third floor is read out from an address (AFL+2) of the RAM 20E, this data being set as target position or set position (STP). In the block 83, it is checked whether the floor data $S_2$ has undergone the learning process or not. To this end, the learning flag for the third floor is read out from the associated address (SDY+2). If this flag is set, the floor data $S_2$ is in the pre-learning state. Thus, control proceeds to the next step 84. In this step 84, when the car is going up, a predetermined value L is subtracted from the data STP set in the preceding step and, when the car is going down, the value L is added to the data STP. Since the car is going up in the present example, a difference (STP−L) is computed and set as renewed STP data. Thus the target position is set to ($S_2$−L) which is ahead by the predetermined value L from the floor data $S_2$ for the third floor. When the car 10 is started, the car is accelerated by the procedure to be taken during acceleration (block 64 in FIG. 8B).

Referring to FIG. 8B, the number of interruptions since starting which stands for the time elapsed T since starting, is counted in the step 100. Next, in the step 101, an acceleration pattern associated with the time T is extracted from a table, not shown, of the ROM 20D. This pattern is entered as VAC into a location of the RAM 20E having a specified address. In the step 102, the pattern data VAC is compared with a rated speed. Control proceeds to the step 103 if VAC<the rated speed and to the step 105 if VAC≧the rated speed. In the step 103, the data VAC is compared with a deceleration command data VDC. If VAC<VDC, the data VAC is set to be an output pattern VPT in the step 104. If VAC≧VDC, the procedure to be taken during acceleration is terminated (step 107) to shift to the procedure to be taken during deceleration. In the step 105, the rated speed is set to be the output pattern VPT and, in the step 106, the rated speed is compared to the deceleration command value VDC. Thus, when VDC>rated speed, the step 64 is terminated and, when VDC≦rated speed, the procedure to be taken during acceleration is terminated in the step 107.

When the decelerating point is reached, the procedure to be taken during deceleration (step 65) is executed, as shown in FIG. 9.

Figure 10:
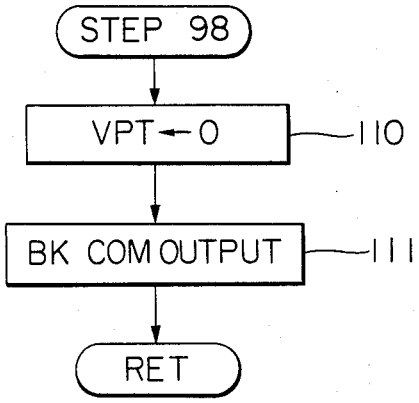

Referring to FIG. 9, in the step 91, the current position SYNC of the car 10 is entered from the current position counter 19. In the next step 92, it is checked whether the car 10 has reached the target or set position STP. Thus, when the set position STP is not equal to the current position SYNC, the remaining distance R to the set position STP is computed in the step 93. In the next step 94, the pattern of deceleration VDC corresponding to said remaining distance R is extracted from the ROM table. The steps 95, 96 are performed in order to ensure that the value of the deceleration pattern does not fall below a predetermined value VCP. In this manner, the deceleration pattern is clipped at VCP. Since the set position STP is designed to be ahead of the actual floor level by a predetermined value L during the learning travel, the point or position where the remaining distance R is zero, that is, the point where STP=SYNC, is necessarily ahead of the floor level. The deceleration pattern VDC may thus be clipped at the design level VCP so that the car approaches the floor at a reduced speed. When the floor sensor 11 is activated in the step 97 by the guide plate 3A for the third floor, the car 10 is halted precisely at the third floor by the floor arrival procedure (step 98 in FIG. 10). Referring to FIG. 10, in the step 110, a zero pattern is set to be an output pattern VPT. In the next step 111, a brake command is issued and the car is mechanically halted by a brake, not shown. When the car 10 is halted, the floor data for the third floor is rewritten in the step 62 to terminate the learning of the third floor data.

It is seen from the foregoing that the floor position data stored in advance in a read-only floor data memory are read out at a predetermined time into a read/write floor data memory and that, when the car is running under predetermined conditions, the contents of the read/write floor data memory are corrected through learning of the car positions computed from the distance traversed by the car. The above learning is executed even during normal running while the car position is precisely controlled. In addition, during this learning process, the risk of the car surpassing the floor level through malfunction may be completely avoided resulting in a drastically improved control accuracy. Besides, the control system of the present invention is simple in design and inexpensive to manufacture.

What is claimed is:

1. A control system for an elevator wherein the distance between the current elevator car position and the target position of a floor at which the car is to be halted is detected on the basis of a car position signal computed from car displacements and a preliminarily stored floor position signal for controlling the car speed, said system comprising:

means for sensing the floors of a building in which the car is mounted, said means issuing an output signal whenever the car has reached a floor;

means for detecting the current car position, said detecting means issuing an output representing the current position of the car; and means for controlling the car speed on the basis of the outputs from said floor detecting means and said current position detecting means;

said control means including (a) a read-only memory for storing floor data concerning respective floor positions of a building according to the building schedule;

(b) a read-write memory for storing floor data concerning respective floor positions to be used for the car speed control; and processor means in said control means coupled to said memories (1) for transferring the floor data in said read-only memory to said read/write memory to be used for car speed control when the power is applied to said control means; (2) for causing the car to travel to a floor, the floor data of which is not corrected in said read.write memory, in such a manner that the car is caused to travel to a target position a predetermined distance ahead of the floor position indicated by the floor data for said floor stored in said read/write memory; (3) for correcting the floor data concerning a target floor stored in said read/write memory by replacing said floor data with the prevailing car position output from said current position detecting means when the output from said floor detecting means has shown that the car has arrived at the target floor, and (4) for storing in said read/write memory the indication that the correction of the position data of said target floor is completed; the correction of the floor data in the read/write memory being not made by the processor means if the current car position data corresponds to the actual floor position data.

2. The control system as claimed in claim 1 wherein said read/write memory has a check area in which data indicating whether the floor data correction has been completed or not is stored.

3. The control system as claimed in claim 2 wherein the data indicating that the correction is not made is entered by said control means into said check area of said read/write memory when power is applied to said control means.

4. The control system as claimed in claim 1 wherein the deceleration pattern used to cause the car to arrive at the target floor is clipped by said control means so as not to fall below a specified value.

* * * * *